US009404390B2

(12) United States Patent
Griese et al.

(10) Patent No.: US 9,404,390 B2
(45) Date of Patent: Aug. 2, 2016

(54) DEVICE FOR INSTALLING AND REMOVING A COMPONENT ON OR IN A STATIONARY GAS TURBINE AND METHOD FOR INSTALLING AND REMOVING A COMPONENT OF A STATIONARY GAS TURBINE

(75) Inventors: Andreas Griese, Berlin (DE); Dirk Muller, Mulheim a.d.Ruhr (DE); Simon Purschke, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 35 days.

(21) Appl. No.: 14/241,473

(22) PCT Filed: Aug. 29, 2012

(86) PCT No.: PCT/EP2012/066772

§ 371 (c)(1),
(2), (4) Date: Feb. 27, 2014

(87) PCT Pub. No.: WO2013/030230

PCT Pub. Date: Mar. 7, 2013

(65) Prior Publication Data

US 2014/0215800 A1 Aug. 7, 2014

(30) Foreign Application Priority Data

Sep. 2, 2011 (EP) ..... 11007152

(51) Int. Cl.
*F01D 25/00* (2006.01)
*F23R 3/60* (2006.01)
*F01D 25/28* (2006.01)

(52) U.S. Cl.
CPC ..... *F01D 25/285* (2013.01); *F23R 3/60* (2013.01); *F23R 2900/00017* (2013.01);

(Continued)

(58) Field of Classification Search
CPC .. F01D 25/285; F23R 900/00017; F23R 3/60; Y10T 29/53978; Y10T 29/49895; Y10T 29/49316; Y10T 29/49318; Y10T 29/4932
USPC ..... 29/889–889.2, 464, 700, 705–707
See application file for complete search history.

(56) References Cited

U.S. PATENT DOCUMENTS 2,070,663 A * 2/1937 Klein et al. ..... 126/33
5,911,680 A 6/1999 Takeoka (Continued)

FOREIGN PATENT DOCUMENTS

CN 2138116 Y 7/1993
CN 1464957 A 12/2003

(Continued)

*Primary Examiner* — David Bryant
*Assistant Examiner* — Bayan Salone
(74) *Attorney, Agent, or Firm* — Beusse Wolter Sanks & Maire

(57) ABSTRACT

A device for installing and removing a component, preferably a burner or a transition pipe of a gas turbine, on or in a stationary gas turbine, is provided. The device includes a rail system having a frame carriage that can be moved along the rail system, on which frame carriage an insertion unit having a carrier unit for the component that can be moved along a movement axis is arranged. In order to specify an especially space-saving and especially rigid design, by means of which components of a gas turbine can be installed and removed relatively simply and quickly, the rail system is designed as a two-track rail system and the movement axis extends between the two rails transversely to an area that extends between the rails.

13 Claims, 4 Drawing Sheets

(52) U.S. Cl.
CPC ..... *Y10T 29/4932* (2015.01); *Y10T 29/49316* (2015.01); *Y10T 29/49318* (2015.01); *Y10T 29/49895* (2015.01); *Y10T 29/53978* (2015.01)

(56) References Cited

U.S. PATENT DOCUMENTS

| | | | | | |
|---|---|---|---|---|---|
| 5,921,075 | A | * | 7/1999 | Shimoyama et al. | 60/797 |
| 6,141,862 | A | * | 11/2000 | Matsui et al. | 29/714 |
| 8,607,451 | B2 | * | 12/2013 | Arase et al. | 29/889.1 |
| 2004/0255570 | A1 | * | 12/2004 | Magoshi et al. | 60/39.23 |
| 2011/0000080 | A1 | * | 1/2011 | Arase et al. | 29/700 |

FOREIGN PATENT DOCUMENTS

| | | | | | |
|---|---|---|---|---|---|
| CN | 101981292 | A | | 2/2011 | |
| EP | 2070663 | A1 | * | 6/2009 | B25J 9/04 |
| EP | 2236939 | A1 | * | 10/2010 | F23R 3/60 |
| JP | H0979577 | A | | 3/1997 | |
| JP | H09108961 | A | | 4/1997 | |
| JP | H09168931 | A | | 6/1997 | |
| JP | H09210361 | A | | 8/1997 | |
| JP | 2003004233 | A | | 1/2003 | |
| RU | 1786886 | A1 | | 12/1995 | |
| RU | 2263247 | C2 | | 10/2005 | |
| RU | 2263807 | C2 | | 11/2005 | |
| WO | 2009077270 | A2 | | 6/2009 | |

* cited by examiner

DEVICE FOR INSTALLING AND REMOVING A COMPONENT ON OR IN A STATIONARY GAS TURBINE AND METHOD FOR INSTALLING AND REMOVING A COMPONENT OF A STATIONARY GAS TURBINE

CROSS REFERENCE TO RELATED APPLICATIONS

This application is the US National Stage of International Application No. PCT/EP2012/066772 filed Aug. 29, 2012, and claims the benefit thereof. The International Application claims the benefit of European Application No. EP11007152 filed Sep 2, 2011. All of the applications are incorporated by reference herein in their entirety.

FIELD OF INVENTION

The invention relates to a device for installing and removing a component on or in a stationary gas turbine and to a method therefor.

BACKGROUND OF INVENTION

Stationary gas turbines have been known for a long time from the extensive prior art. One known type of stationary gas turbine is equipped with combustors, known as tubular combustors or can-type combustors, which are evenly distributed around the circumference. Each of these tubular combustors always comprises a burner, sitting in the gas turbine housing, having a burner pipe to which a transition pipe or transition connects. The transition pipes guide the hot gas produced in the individual cylindrical burner pipes into an annular duct. To this end, the transition pipes have, on the burner side, a circular cross section which turns into a sector-shaped cross section on the outlet side. The sector-shaped cross sections of all the transition pipes generally abut against one another in the circumferential direction such that the hot gas produced in the individual tubular combustors can be guided, with little loss, into the annular duct of the gas turbine. In the annular duct, the turbine blades arranged in the turbine are arranged in stages.

When servicing, if one of the burners, the burner pipes or the transition pipes has to be replaced, it was the case until now that installers had to release the attachment of the relevant gas turbine component, after which this component could be removed—by hand or with the aid of a hoist—from inside the housing through the burner opening arranged in the housing.

Thereafter, and also during assembly of the gas turbine, functional components to be inserted can then also be moved with the aid of the hoist to the gas turbine and then into it.

In particular, using the hoist, components to be detached or attached on or in the lower housing half can only be transported to their intended location in an inadequate manner since the gas turbine housing partially blocks the path of the hoist or its cables or chains.

In order to make this work easier, U.S. Pat. No. 5,921,075 discloses a burner replacement system in which a rail is attached at a circumferential flange connection of two axially adjacent parts of the gas turbine housing, wherein a carriage of complex design can be moved along this rail in order to transport the burner to be installed. The carriage is equipped with an articulation and with a burner carrier which can be displaced in translation such that it can transport individual burners of the gas turbine to their intended location. With the aid of the known burner replacement system, the transition pipes can also be removed from inside the gas turbine or inserted inside the gas turbine.

A disadvantage of the known device is, however, that it is very large and requires a comparatively large maneuvering space around the gas turbine housing. This free maneuvering space is so large that its outermost radius is far greater than the outermost radius of the gas turbine housing. However, this maneuvering space is not always available. A further disadvantage of the known device is that, on account of the comparatively long and free-ending rod assembly on the carriage, and the considerable weights of the components to be replaced, such as burners and transition pipes, these can only be positioned with insufficient precision with respect to the component opening through which they are to be introduced into the gas turbine.

U.S. Pat. No. 6,141,862 shows a further development of the device from U.S. Pat. No. 5,921,075. In order to further support the carriage end, which previously projected freely, a second endless circumferential rail is provided in the central section of the compressor. One disadvantage, however, is the extensive configuration of this variant. In addition, it required the annular fuel distributor to be dismantled before mounting the burner removing device.

Furthermore, a tool for removing combustor components of a gas turbine is known from EP 2 236 939 A1. The tool comprises a telescopic unit for moving the combustor component into the gas turbine. However, the tool must be attached to each insertion opening, which is comparatively laborious.

In addition, a crane solution for installing and removing combustor components of a gas turbine is known from EP 2070663 A1.

SUMMARY OF INVENTION

It is therefore an object to provide a device for installing and removing a component on or in a stationary gas turbine, which device, on one hand, is comparatively compact and, on the other hand, allows exact-fit positioning of the relevant component on or in the stationary gas turbine. It is a further object to provide a method for installing and removing a component of a stationary gas turbine, which method can be carried out comparatively quickly without a particularly large installation space requirement.

The object directed at the device is achieved by a device according to the device features as claimed. The object directed at the method is achieved by a method as claimed. Advantageous configurations of the device and of the method are specified in the respective subclaims. Unless otherwise indicated, the features of different subclaims can be combined with one another in any manner desired.

It is provided according to aspects of the invention that the device for installing and removing a component on or in a stationary gas turbine comprises a rail system having a frame carriage which can be moved on and along it and on which there is arranged an insertion unit having a carrier unit for the component which can be displaced thereon along a displacement axis, wherein the rail system has two tracks, that is to say comprises two rails, wherein both rails of the rail system are configured so as to be attached to a wall section, having the insertion opening, of the gas turbine and the displacement axis extends between the two rails, transversely to—preferably perpendicularly to—a plane defined between the rails. The frame carriage, the insertion unit and the carrier unit—with or without a component temporarily attached thereto—will also be referred to hereafter as the movable unit.

Embodiments of the invention are thus based on the knowledge that it is disadvantageous to attach the rail system known from the prior art on the housing flange of the gas turbine. Attaching the rail system close to the insertion opening is much more useful in terms of construction. As there is, however, only limited space available at this part of the housing, the invention proposes the use of a two-track rail system which is attached to that same wall on which the insertion openings are also arranged. In this case, the rails and the components sliding or rolling thereon can be made smaller than in the case of a configuration having only one rail. In order to obtain a particularly small device overall, it is provided that the two rails can be attached to the housing of the gas turbine on either side—that is to say further inward and further outward with respect to the machine axis of the gas turbine—of the insertion opening for the relevant component. The component to be installed or removed can then be installed between the two rails, in that the carrier unit can be displaced along a displacement axis, which displacement axis is transverse, preferably perpendicular to a plane defined between the two rails. The rails are therefore only wide enough apart for the insertion opening to be completely free when the device is attached to the gas turbine. Nonetheless, the two rails are positioned right next to the insertion opening. The relevant component can thus be readily moved along the displacement axis, between the two rails into or out of the gas turbine. It has further been recognized that, by means of the two-track rail system, much greater stiffness and strength of the device overall can be achieved at the same time, since the weight of the component and also of the device itself are diverted in a distributed manner via the carrier unit, the supporting rails and the frame carriage, and then via a plurality of contact points, into the rail system, and from there further into the housing of the gas turbine.

Of further advantage is that, with respect to the central axis of the gas turbine, no large diameter such as in the case of the prior art is necessary for the maneuvering space of the installation device, since even the outer rail of the rail system is positioned inside the outermost diameter of the housing of the gas turbine.

Advantageous configurations of the invention are specified in the subclaims.

The rail system is formed either as an endless circular path or as an arc of a circle. It is preferable, however, for the rail system to be formed as an endless circular path such that, with the aid of this endless circular path, the frame carriage and the insertion unit and carrier unit arranged thereon can move to every one of the insertion openings arranged on the gas turbine. In the case of a rail system formed as an arc of a circle, the rail system would have to be dismantled and reassembled multiple times, each time at another circumferential position. Both configurations shorten the set-up time for preparing the installation and removal of the component on or in the stationary gas turbine.

According to a further advantageous configuration, the rail system comprises, for each rail, a plurality of rail holders for attaching the rail system to the gas turbine. The rail holders can be configured in a modular fashion so as to be able to attach them to the insertion openings of the burner. However, the rail system can also be attached next to the insertion openings, for example also by means of bolts.

According to a further advantageous configuration, the frame carriage comprises, for each rail of the rail system, at least two roller carriages which are moved synchronously on the respective rail and which preferably comprise, in each case, at least two rollers. With the aid of the total of four roller carriages and therefore altogether eight rollers, the frame carriage can be securely attached to the two-track rail system without further auxiliary means having to prevent derailing of the frame carriage, which can be moved along the circumference of the gas turbine. In a particularly preferred configuration, each roller carriage has four rollers, such that the frame carriage has 16 rollers in total, such that the frame carriage supports itself on both sides of the relevant rail at each of its four corners. In addition, the weight of the movable unit and of the component to be installed can thus be diverted into the rail system and the gas turbine housing via four corner points of the frame carriage—more precisely via the eight rollers—in a much more widely distributed manner than in the prior art. This avoids any concentrated loads, which would require larger components for the device.

The rollers can preferably be made to roll on those sides of the rails which in each case face the other rails. In other words, the rollers press in each case via their rolling surface against the inside of the respective rail such that, in principle, the two rails are pressed slightly apart by the rollers. The rollers are preferably configured as deflection rollers such that, in principle, the rolling surface is delimited on both sides by a wheel flange. This simultaneously produces a form fit between the respective rail and the relevant roller, such that, for each circumferential position of the frame carriage on the rail system, the frame carriage is reliably prevented from derailing from the rail system.

According to a further advantageous configuration, the insertion unit comprises at least two supporting rails having linear rails, along which the carrier unit can be displaced. This ensures a guided movement of the component when introducing it into the gas turbine or when removing it from the gas turbine. This prevents undesirable, accidental contact between the component and the housing, thus protecting both elements from damage.

BRIEF DESCRIPTION OF THE DRAWINGS

Further embodiments of the invention, further features and advantages accompanying the features are indicated in the following description of figures, in which.

In all the figures, identical components are provided with identical reference signs.

DETAILED DESCRIPTION OF INVENTION

Figure 1:
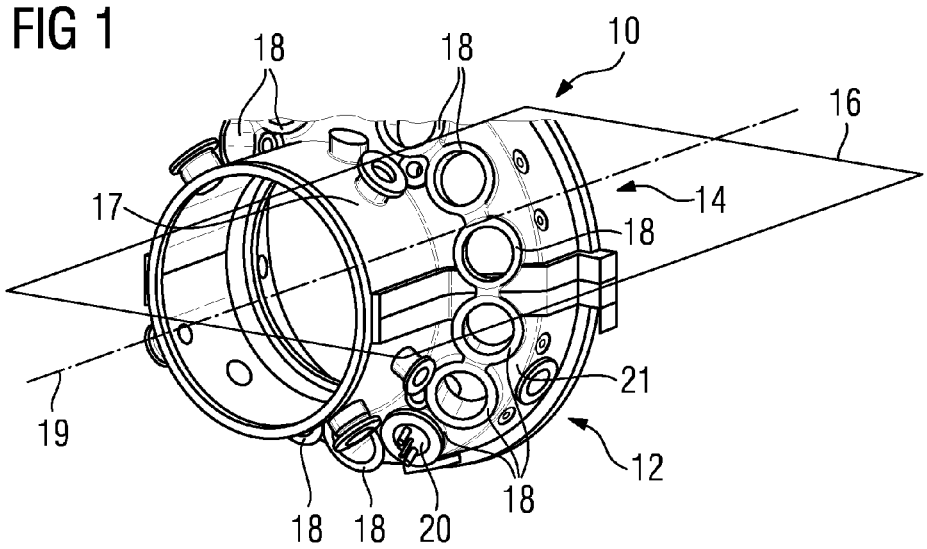
FIG. 1 shows a perspective representation of a housing section for stationary gas turbines.

FIG. 1 shows, in a perspective representation, a portion of the housing 10 of a stationary gas turbine. The housing portion comprises a lower half 12 and an upper half 14 which abut against each other, in the manner of a flange, in a parting plane 16 and whose flanges are screwed to one another. Each half has a coaxial wall section 17 and a wall section 21 arranged at a steep angle with respect thereto. Openings 18, which all lie on an imaginary circle which is concentric with the machine axis 19, are provided in the wall section 21 of each half 12, 14. The openings 18 are burner openings or insertion openings. In the lower half 12, a burner 20 is inserted into one of the openings 18, whereby the opening 18 is closed. It is also possible to introduce other components of the gas turbine into the inside through the opening 18, if lifting off the upper half 14 of the housing 10 is too laborious. The components can be burner pipes or transition pipes known from the prior art.

In order to permit a further simplified and also low-risk removal of the burner 20, of the burner pipe or else of the transition pipe, and at the same time to provide a space-saving construction, it is provided to use a device 22 (FIG. 2) for installing and removing these gas turbine components. Although the following exemplary embodiment merely describes the installation of a burner of the gas turbine, it is not limiting. Of course, the device 22 is also suitable for the removal of a burner. Moreover, instead of the burner, it is also possible to install or remove transition pipes with the aid of the device 22.

Figure 2:
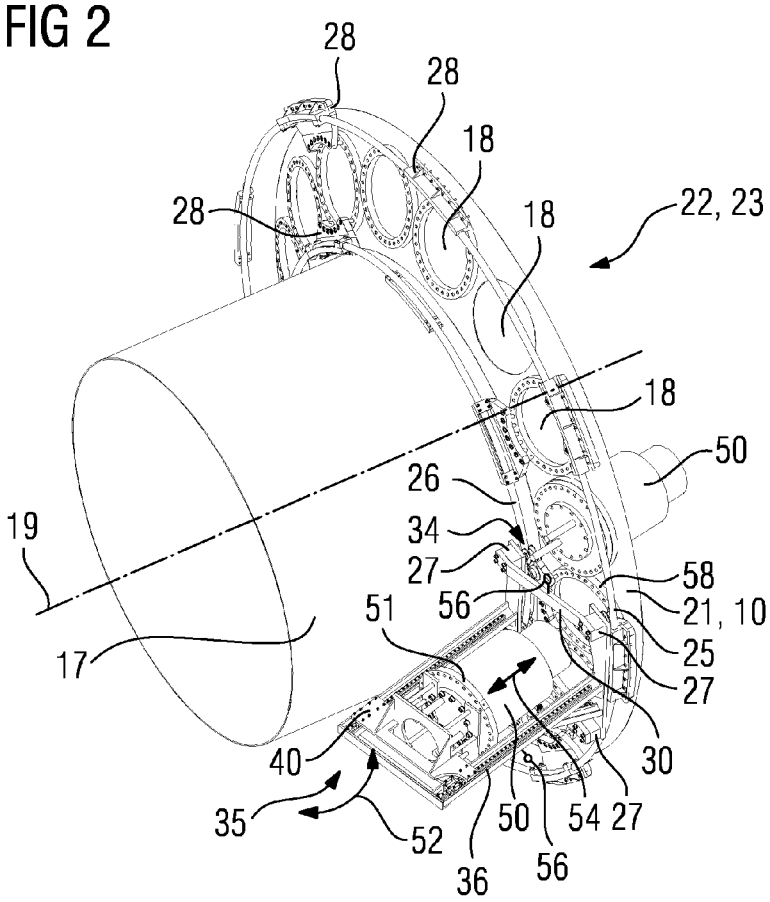
FIG. 2 shows a perspective, schematic representation of a housing portion of the gas turbine with the device comprising a rail system attached to the housing and a unit which can be moved along the rail system.

In FIG. 2, for reasons of clarity, parts of the housing and of the gas turbine which are not of any further relevance for the invention are not represented. The openings 18 are positioned on the wall section 21 of the gas turbine housing 10, which is at only a comparatively slight angle to the radial direction of the machine axis 19.

The device 22 comprises a rail system 23 having two rails, an outer rail 25 and an inner rail 26. The terms "inner" and "outer" relate to the machine axis 19 of the gas turbine. Each rail 25, 26 is attached to the wall section 21 via a plurality of rail holders 28. The inner rail 26 can, in addition or as an alternative, also be attached to the coaxial wall section 17. The device 22 further comprises a unit 35 which can be moved along the rails 25, 26. This unit 35 has a frame carriage 30 and an insertion unit 36 attached to the frame carriage 30 and having a carrier unit 40 which can be displaced thereon in the longitudinal direction. The component to be installed—a burner 50 in the case of FIG. 2—for the tubular combustors of the gas turbine is screwed onto the carrier unit 40. Another burner 50 is already attached in one of the openings 18.

Figure 3:
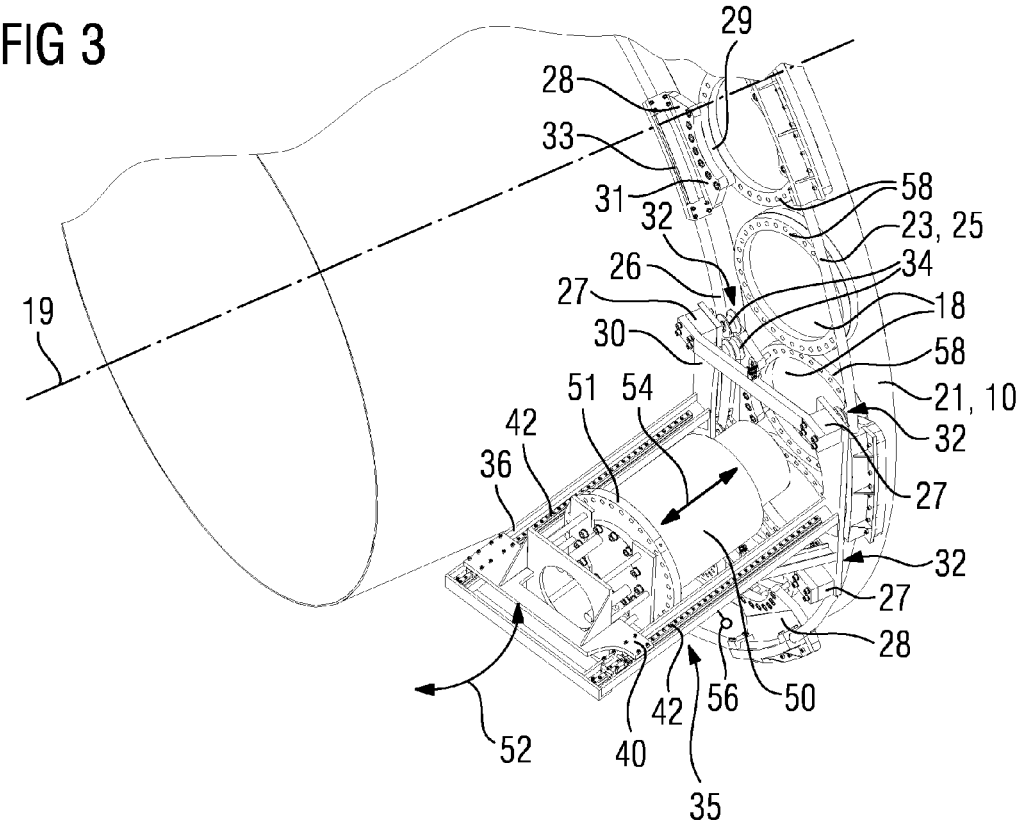
FIG. 3 shows an alternative to the rail system represented in FIG. 2.

FIG. 3 shows, in contrast to FIG. 2, an alternative device 22, which differs from the device 22 of FIG. 2 substantially in that the rail system 23 extends only over an arc of a circle of the circumference of the gas turbine housing 10 and is not configured—as in FIG. 2—as an endless circular path.

As can be seen in particular from FIG. 3, at each corner 27 of the frame carriage 30 there is provided a roller carriage 32 having in each case two rollers. The rollers 34 are in the form of deflection rollers, that is to say formed with a wheel flange on both sides such that the rollers 34 cannot slide off to the side of the rails 25, 26. The frame carriage 30 and therefore also the insertion unit 36 with the carrier unit 40 can be displaced along the rails 25, 26 in the circumferential direction of the gas turbine housing 10, this being represented by the double arrow 52. At the same time, the carrier unit 40 can be displaced along a rail system 23, this being represented with the aid of the double arrow 54. The travel of the frame carriage 30 and the displacement axis of the carrier unit 40 are thus transverse to one another.

Figure 4:
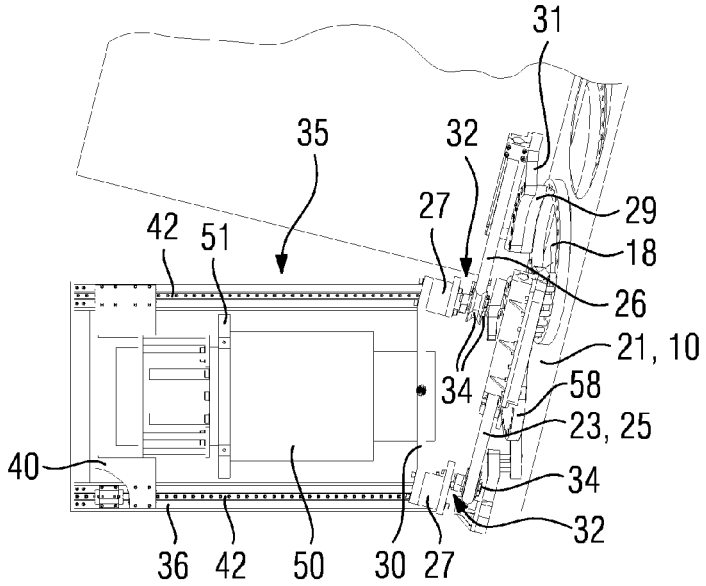
FIG. 4 shows a side view of the device for installing and removing gas turbine components which is attached to the gas turbine housing, FIG. 5, 6 show two different attachments of roller carriages on the frame carriage

With the aid of the devices 22 represented in FIGS. 2 to 4, it is possible to install and remove a component, for example a burner 50, on or in the stationary gas turbine in a comparatively simple and exact-fitting manner. In order to install the burner 50 on the housing 10 of the gas turbine, the rail system having the rails 25, 26 must first be arranged on the housing 10 of the gas turbine. Next, the frame carriage 30, having the insertion unit 36 arranged thereon and having a carrier unit 40 which can be displaced thereon along a displacement axis, is introduced into the rail system 23. Simultaneously, a sheathed cable is attached to a hook 56 of the displaceable unit 35 and the unit 35 then hangs from the sheathed cable. The unit 35 can be moved to any position with the aid of the sheathed cable, without installers having to hold the weight of the unit 35 and of the burner. In a twelve o'clock position, the burner 50 can be temporarily attached to the carrier unit 40 for the last section of the transport path. By changing the length of the sheathed cable, the burner 50 can be transported with the aid of the movable unit 35 to that opening 18 at which the burner 50 is to be attached. There, the unit 35 is then secured against further movement, which on one hand takes the load off the sheathed cable and on the other hand allows a particularly exact alignment of the burner 50 with respect to the opening 18. Next, the carrier unit 40 is displaced along its displacement axis such that, during this time, the burner 50 enters the gas turbine through the opening 18 without any component-damaging contact. Once the final position has been reached, a flange 51 arranged on the burner 50 can be screwed to a flange 58 located around the opening 18. The burner 50 is then detached from the carrier unit 40, whereupon the installation of the relevant burner 50 is complete. The movable unit 35 then travels back to a loading position in which the next component to be installed can be attached to the carrier unit 40.

It is of particular advantage in this context that the components to be installed can be installed at an easily accessible location in a "loading position" on the movable unit 35 and can be transported into an installation position which is less accessible by means of a type of revolver system. In particular, the openings 18 arranged in the lower housing half are to be considered as comparatively difficult to reach since, in the absence of a device 22 of this type, they can only be fitted with burners unsatisfactorily with the aid of a loading crane. A further advantage of the device 22 is that installation steps can, in part, be carried out in parallel. It is thus conceivable, for example, that a burner 50 positioned with the aid of the frame carriage 30 is first helpfully attached to its opening 18 and then the attachment to the carrier unit 40 is released. The frame carriage 30 along with the carrier unit 40 is then available to be loaded with the next burner 50 to be installed, during which time the first helpfully attached burner 50 is then attached to the housing 10 as specified while at the same time the frame carriage 30 is loaded with the next burner 50.

The rail holding arrangement 28 comprises a mount 29, a plate 31 and a seat 33. The use of the mount 29 is of particular advantage if the rail holder 28 is to be mounted on a gas turbine to which burners are still attached on the opening 18. In this case, the use of a mount 29 is not necessary, which means that, regardless of whether or not a burner 50 is attached to an opening 18, the rail 25 or 26 is always at the same distance from the wall section 21.

However, the rail holding arrangements 28 are preferably not attached to the flange 58 on the end face side but are either attached laterally to the flange, laterally to the wall section 21 or else to the wall section 17 itself. This means that every opening 18 can be fitted with burners 50 and is not blocked by any rail holding arrangements 28.

Figure 5:
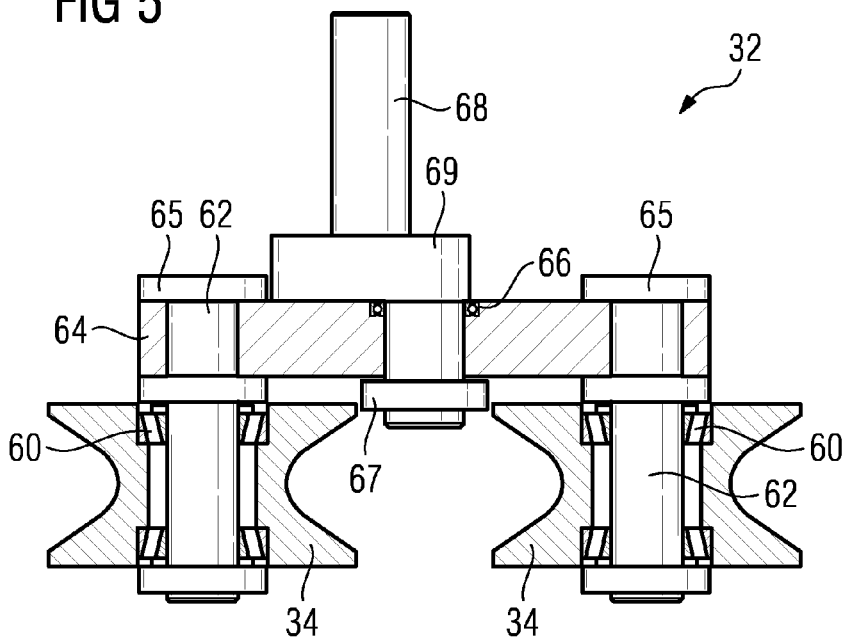
Figure 6:
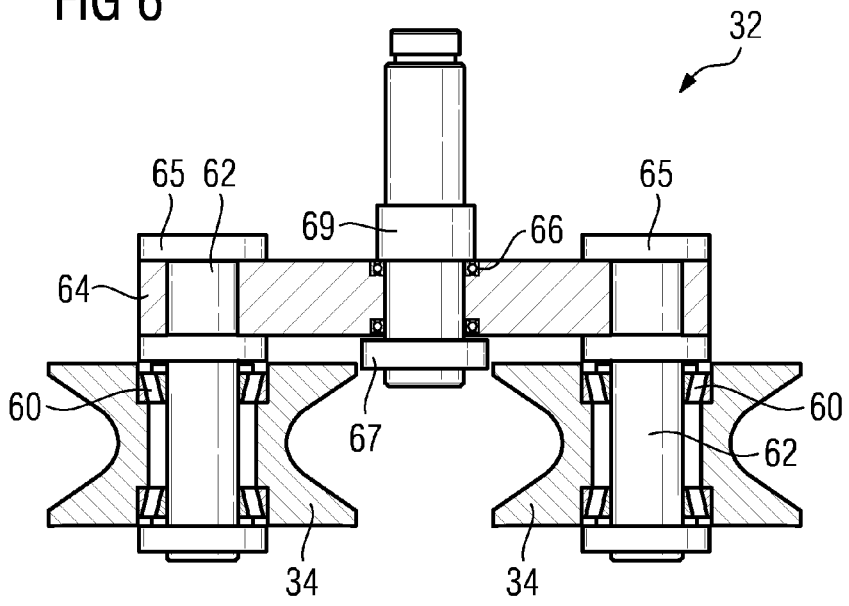

FIGS. 5, 6 show, in cross section, two different configurations of roller carriages 32 having in each case two rollers 34 arranged thereon. They are mounted on the axles 62 by means of an applied bearing arrangement having two roller bearings 60, wherein they are axially secured in one direction by means of a shaft shoulder and in the other direction by means of a groove nut. Both axles 62 are securely clamped in the axle holder 64 by means of a nut 65. In order to ensure that both rollers 34 always lie against the rail, the axle holder 64 is rotatably mounted. To that end, there is provided a bearing arrangement, having a radial sliding bearing 66 and two appropriate axial sliding bearings, which is immobilized in the axial direction by means of a groove nut 67 pressed onto a lug. The bearing arrangements for the axle holder 64 on the longitudinal struts inside and outside are in this case achieved differently. An eccentric 69 (FIG. 5), which allows the roller carriage 32 to be shifted in the direction of the rail, is introduced inside the longitudinal brace. At the same time, the alignment of the movable unit 35 with respect to the openings 18 can be adjusted by means of the eccentric. To that end, the upper axle portion of the eccentric 69 is inserted with a clearance fit into the bearing seat. By means of an introduced hex socket on the end face of the upper axle portion 68 of the eccentric 69 and the external threading, the eccentric can be pressed against the inner rail with a defined force and can be fixed by tensioning the components.

Figure 7:
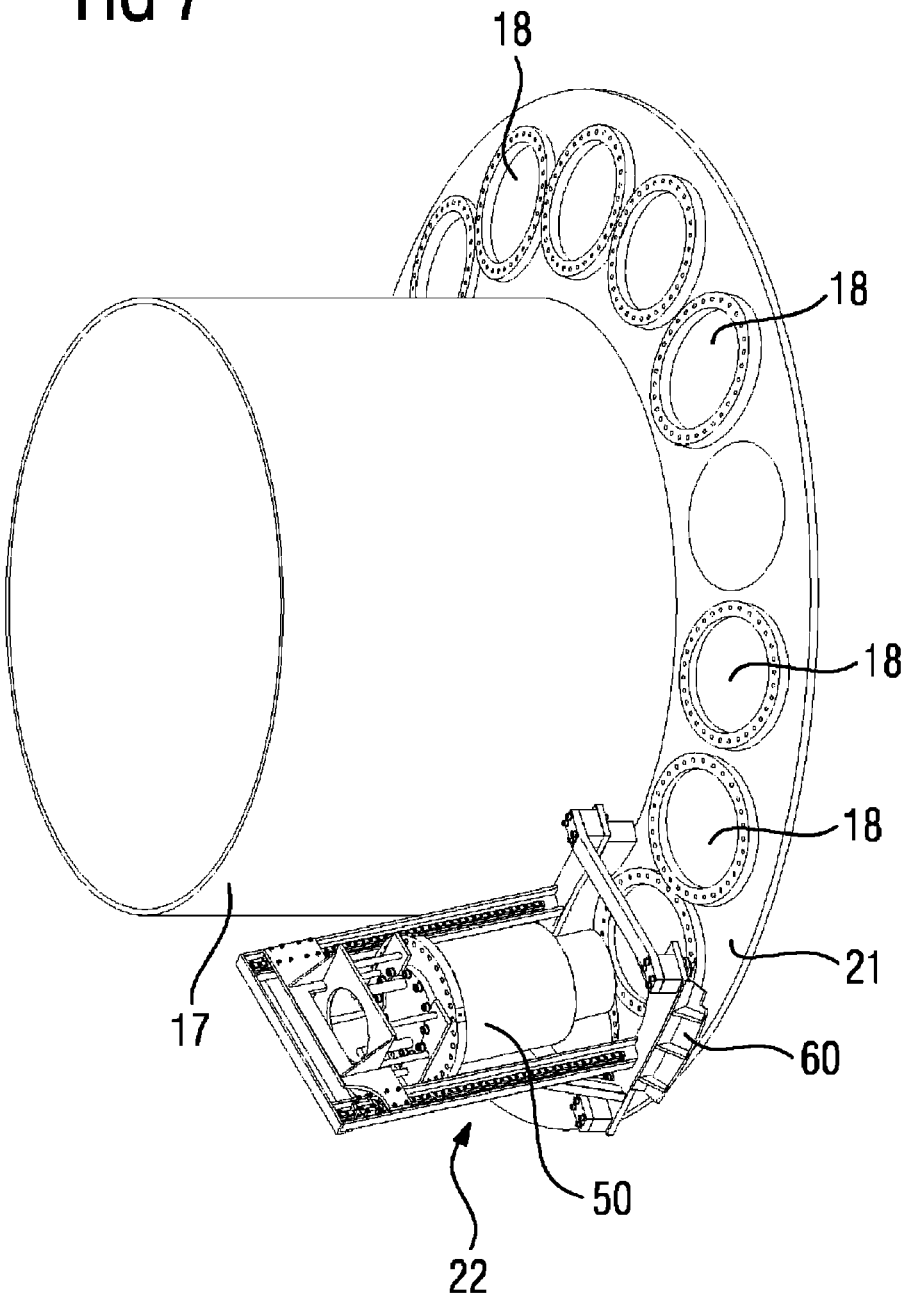
FIG. 7 shows an alternative configuration in which, instead of the rail system, the frame carriage is attached directly to the housing of the gas turbine.

It is of course also possible to configure the frame carriage 30 without a roller carriage 32 and to attach it directly to the housing 10 of the gas turbine with the aid of an intermediate tool 60, as shown in FIG. 7.

In all, embodiments of the invention thus relate to a device 22 for installing and removing a component, preferably a burner 50 or a transition pipe of a gas turbine, on or in a stationary gas turbine, comprising a rail system 23 having a frame carriage 30 which can be moved on and along it and on which there is arranged an insertion unit 36 having a carrier unit 40 for the component which can be displaced thereon along a displacement axis. In order to provide a particularly space-saving and particularly rigid construction, by means of which components of a gas turbine can be installed and removed comparatively simply and quickly, it is provided that the rail system 23 is formed with two tracks, and the displacement axis extends between the two rails 25, 26, transversely to a plane defined between the rails 25, 26. The defined plane is thus annular in shape and only slightly inclined with respect to the radial direction of the machine axis 19.

The invention claimed is:

1. A device for installing and removing a component on or in a stationary gas turbine, comprising:

a rail system having a frame carriage adapted to be moved on and along it and on which there is arranged an insertion unit having a carrier unit for the component adapted to be displaced thereon along a displacement axis, wherein the rail system has two rails, such that the two rails of the rail system are configured so as to be attached to a wall section of the gas turbine, the wall section comprising an insertion opening therethrough, and wherein the displacement axis extends between the two rails, perpendicularly to a plane defined by the rails.

2. The device as claimed in claim 1, wherein the rail system is formed as an endless circular path or as an arc of a circle.

3. The device as claimed in claim 1, wherein the rail system comprises, for each rail, a plurality of rail holders for attaching the rail system to a gas turbine.

4. The device as claimed in claim 1, wherein the frame carriage comprises, for each rail of the rail system, at least two roller carriages adapted to be moved synchronously on the respective rail.

5. The device as claimed in claim 4, wherein the roller carriage comprises at least two rollers.

6. The device as claimed in claim 4, wherein the two rails have in each case an inner side, facing the other rail, on which rollers of the roller carriages are adapted to roll.

7. The device as claimed in claim 6, wherein the rollers lie against the two rails under prestress.

8. The device as claimed in claim 1, wherein the insertion unit comprises at least two linear rails having supporting rails, along which the carrier unit is adapted to be displaced.

9. A gas turbine having a number of insertion openings, arranged in a wall section, for installing gas turbine components, wherein rails are attached to the wall section and the rails are formed as the rails of a device as claimed in claim 1.

10. A method for installing and removing a component of a gas turbine, comprising:

arranging a device as claimed in claim 1 on a housing of the gas turbine such that the insertion opening is provided between the two rails; and installing the component of the gas turbine on or in the gas turbine and/or removing the component of the gas turbine by means of the device.

11. The method as claimed in claim 10, wherein the component comprises a burner or a transition pipe of the gas turbine and the insertion opening constitutes a burner opening of the gas turbine.

12. A device for installing and removing a component on or in a stationary gas turbine, comprising:

a rail system comprising two rails attached to a combustor section outer casing of the gas turbine, wherein the combustor section outer casing comprises an insertion opening disposed therethrough and between the two rails;

a frame carriage adapted to be moved on and along the rail system;

an insertion unit arranged on the carriage frame; and a carrier unit arranged on the insertion unit and adapted to be displaced on the insertion unit along a displacement axis, wherein the displacement axis extends between the two rails, transverse to a surface of a shape bounded by the rails.

13. A device for installing and removing a component on or in a stationary gas turbine, comprising:

a rail system comprising two rails attached to a combustor section outer casing of the gas turbine, wherein the combustor section outer casing comprises an insertion opening disposed therethrough and between the two rails;

a frame carriage adapted to be moved on and along the rail system;

an insertion unit arranged on the carriage frame; and a carrier unit arranged on the insertion unit and adapted to be displaced on the insertion unit along a displacement axis, wherein the displacement axis extends between the two rails, normal to a surface of a frustoconical shape defined by the rails.

* * * * *